United States Patent [19]

Hartness et al.

[11] 4,248,029

[45] Feb. 3, 1981

[54] CASE PACKER LOADING DEVICE

[76] Inventors: Thomas P. Hartness; Robert G. Hartness, both of Greenville, S.C.

[21] Appl. No.: 38,479

[22] Filed: May 14, 1979

[51] Int. Cl.[3] ..... B65B 39/02

[52] U.S. Cl. ..... 53/248

[58] Field of Search ..... 53/248, 539, 543, 247, 53/260, 537

[56] References Cited

U.S. PATENT DOCUMENTS

| | | | |
|---|---|---|---|
| 3,570,216 | 3/1971 | Frentzel | 53/539 X |
| 3,673,756 | 7/1972 | Prete et al. | 53/248 X |
| 3,788,034 | 1/1974 | Hartness et al. | 53/248 |

*Primary Examiner*—Travis S. McGehee
*Attorney, Agent, or Firm*—Bailey, Dority & Flint

[57] ABSTRACT

A grid set for use on an article loading machine for guiding cartons of articles such as drinks into a case carried therebelow. A plurality of guide arms are pivotally carried in a rectangular frame directly below a drop assembly for guiding the cartons of drinks into a cardboard case ensuring that the corners of the case are extended fully. Cam means cooperate with the guide arms for holding the cartons of drinks as the entire frame is lowered to the case for gently depositing the cartons of drinks into the case.

7 Claims, 10 Drawing Figures

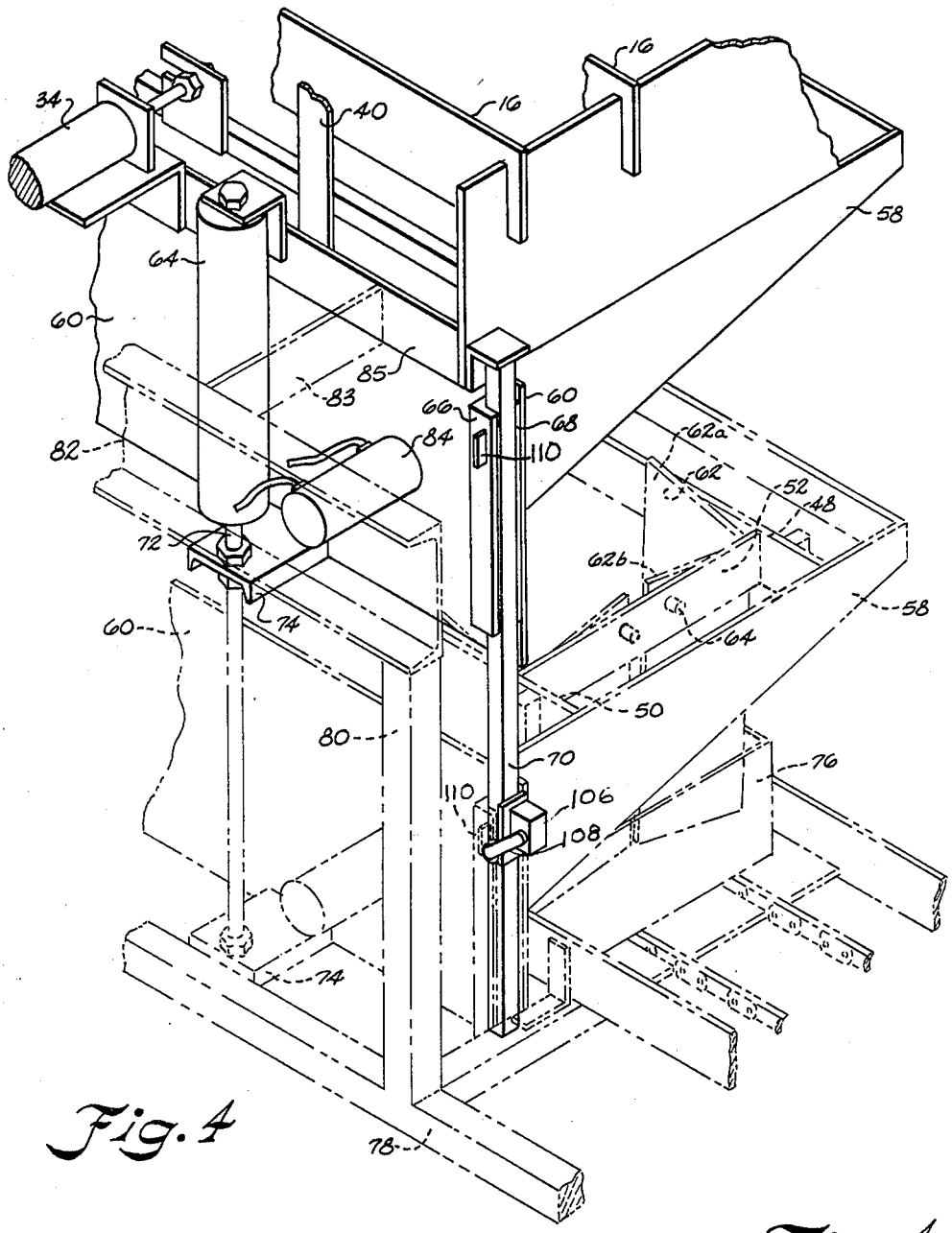
Fig. 4
Fig. 4a
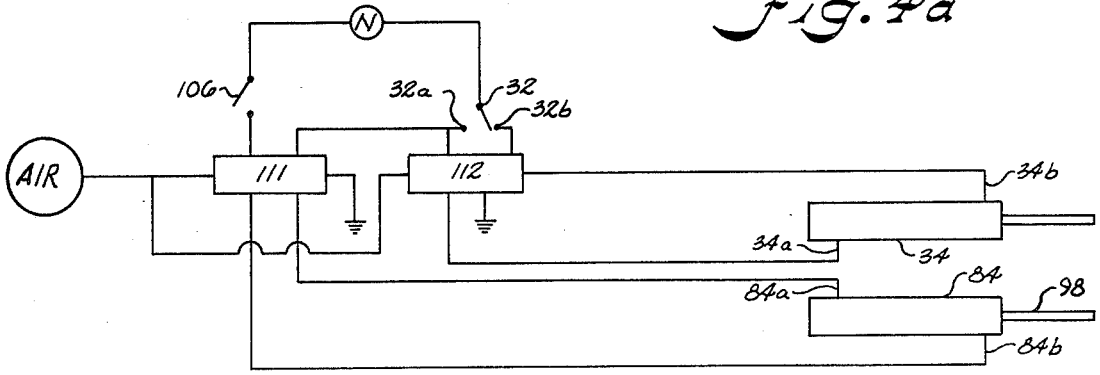

CASE PACKER LOADING DEVICE

BACKGROUND OF THE INVENTION

Heretofore, when cartons such as cartons containing six drinks were loaded into cases, they are normally fed onto a case packer in two rows directly above a grid set. A drop assembly was utilized for shifting the four cases of drinks allowing them to drop through the grid set into a cardboard carton. Normally, the grid set consist of a rectangular frame having flexible guide members carried around the periphery thereof for extending into the case.

One problem with such devices was that the drinks were allowed to drop abruptly into the case often breaking some of the bottles or tearing the cartons allowing bottles to fall from the six-pack cartons.

Furthermore, a problem with such devices is that frequently the cardboard cases would not be fully extended and, as a result, when the flexible fingers were inserted into the case for guiding the cartons therein, sometimes the case was bent or the cartons not properly loaded therein as a result of the case not being fully extended.

In loading articles into cases, the articles are either dropped through grid sets into a case that is carried on an elevated platform or the entire grid set itself is lowered down into the case. Even though the elevator upon which the case is to be loaded is positioned directly below the grid set, often there is a drop of more than a foot producing a substantial impact when striking the bottom of the case. This impact sometimes damages the articles and cartons.

SUMMARY OF THE INVENTION

A grid set for use on an article loading machine for guiding a charge of articles such as a six-pack of drinks carried on a drop assembly from the drop assembly to an empty case carried therebelow. The case is normally a cardboard case, and it is necessary that it be fully extended for receiving the cartons of drinks. The grid set includes a substantially rectangular frame which is carried below the drop assembly. A guide arm is carried in each corner of the frame and each guide arm includes a rigid sheetmetal member that is bent at a right angle producing a pair of side walls that are joined substantially at right angles to each other. The guide arms are pivotally supported in respective corners of the frame with the lower ends of the guide arms being pivoted towards the center of the frame. As a result, when the grid set is lowered into a case for loading the cartons of drink, the lower end of the guide arms are positioned inwardly from the walls of the case. When the cartons are dropped through the guide arm, they are pivoted rearwardly back into the corners of the case extending the case for properly receiving the cartons of drinks.

In order to minimize the shock that occurs when the cartons are dropped through the article loading machine into a case, cam means are provided on the frame for engaging the walls of the guide arms for positively holding the guide arms in an inclined position towards the center of the frame. When the guide arms are in this position, the cartons stop and are held within the confines of the four guide arms until the cam means is released. Normally, the cam means are not released until the guide arms are located within the case so that upon releasing of the cam means, the guide arms are pivotally rearwardly into the corner of the case expanding the case outwardly allowing the cartons to be gently dropped into the case.

In order to prevent the cartons of bottles from binding on the article loading machine and not dropping through the grid assembly when the drop assembly is shifted, a pa,ir of plates are pivotally supported adjacent the end of the grid assembly. These plates are held slightly at an angle to a vertical axis so as to prevent the cartons from being pushed flush against the end of the loading machine. Actually, the plates are held flush against the mechanism which triggers a switch indicating that the case packer has been loaded with articles. After the pivotal plates have been pressed against a triggering mechanism indicating that the case loading machines has been loaded with cartons, the drop assembly is shifted laterally. As the drop assembly is shifted laterally, the vertically extending plates are allowed to pivot rearwardly providing a gap between the cartons of drinks permitting them to drop freely down through the grid set. A set of stops (not shown) are provided for stopping additional incoming cartons until the cartons on the grid have been dropped and the grid has returned to the receiving position.

Accordingly, it is an important object of the present invention to provide a grid set for an article loading machine which aids in gently loading cartons into cases.

Still another important object of the present invention is to provide a grid set for an article loading machine wherein cartons of articles are held within a grid set as the grid set is lowered down to a case for depositing the cartons into the case.

Still another important object of the present invention is to provide a grid set for an article loading machine which include four guide arms bent in the form of angle arms which are pivotally secured on a frame so that as the cartons of articles are passed therethrough, the guide arms are pivoted rearwardly into the corner of a case for fully extending the case.

Still another important object of the present invention is to provide pivotally supported plate adjacent the end of the article loading machine against which the cartons abut prior to being dropped through the grid set and upon activating a drop assembly produces sufficient space for permitting the cartons to drop freely through the grid set.

Still another important object of the present invention is to provide strong rigid guide arms that are not bent or broken when a receiving case is misaligned with the grid during depositing of the articles therein.

Another important object of the present invention is to provide an apparatus which allows cartons to be dropped in two stages minimizing the shock normally incurred when depositing articles into cases.

These and other objects and advantages of the invention will become apparent upon reference to the following specification, attendant claims, and drawings.

FIG. 4 is an enlarged fragmentary perspective view illustrate in full lines a grid set forming part of a case loading machine in a raised position and illustrating in phantom lines the grid set in a lowered position wherein the articles are deposited into a case.

FIG. 4*a* is a schematic diagram of the pneumatic controls for the case packer.

Figure 5:
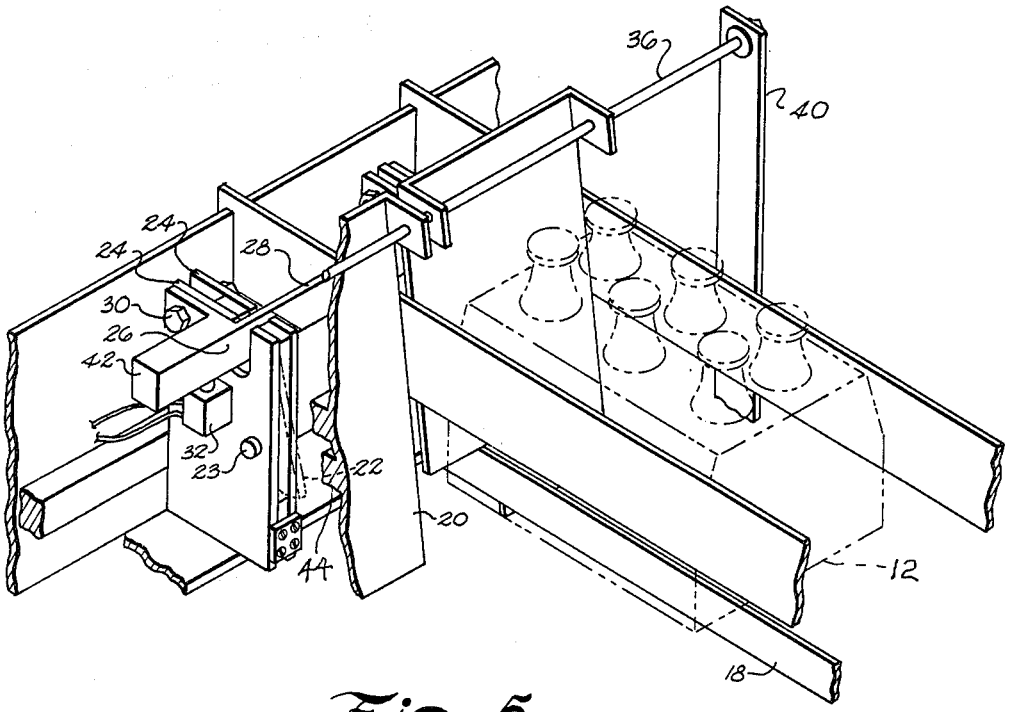

FIG. 5 is an enlarged fragmentary perspective view illustrating the trip assembly associated with the case loading device.

Figure 6:
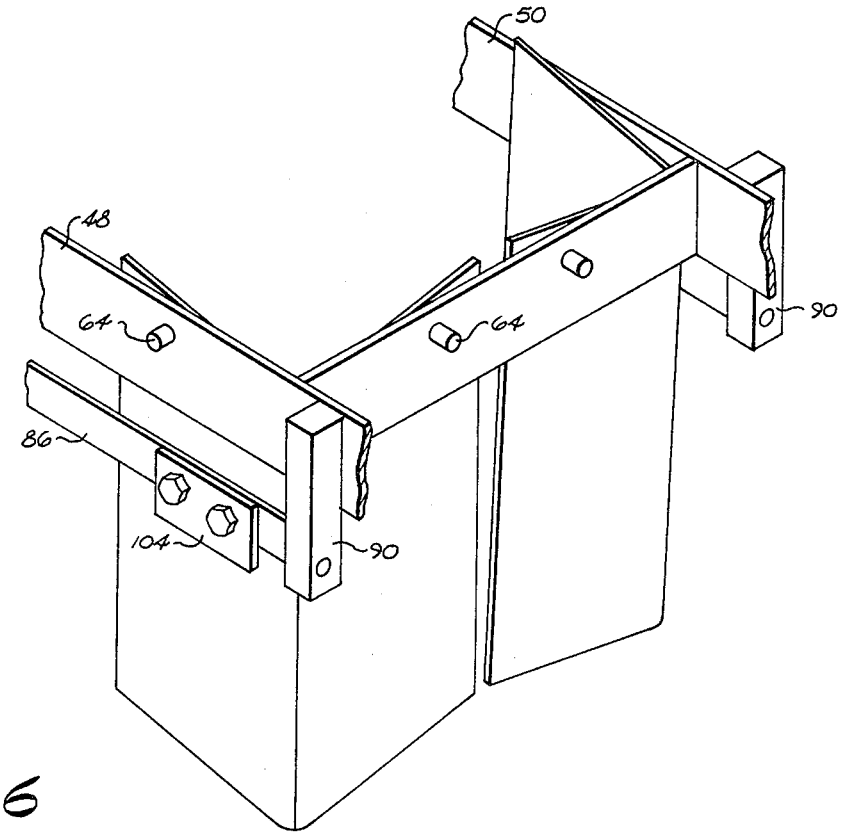

FIG. 6 is an enlarged perspective view illustrating the guide arms forming part of the grid set.

Figure 7:
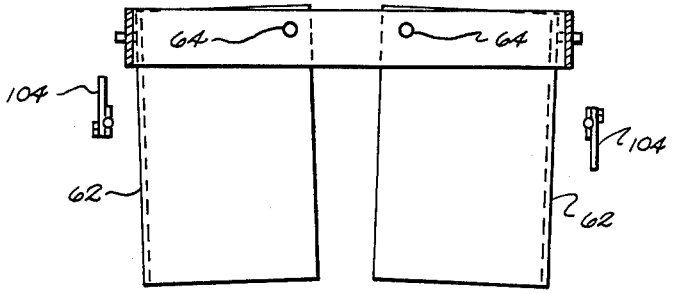
Figure 8:
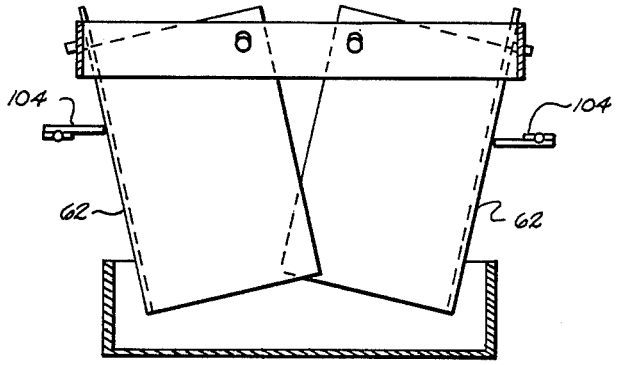
Figure 9:
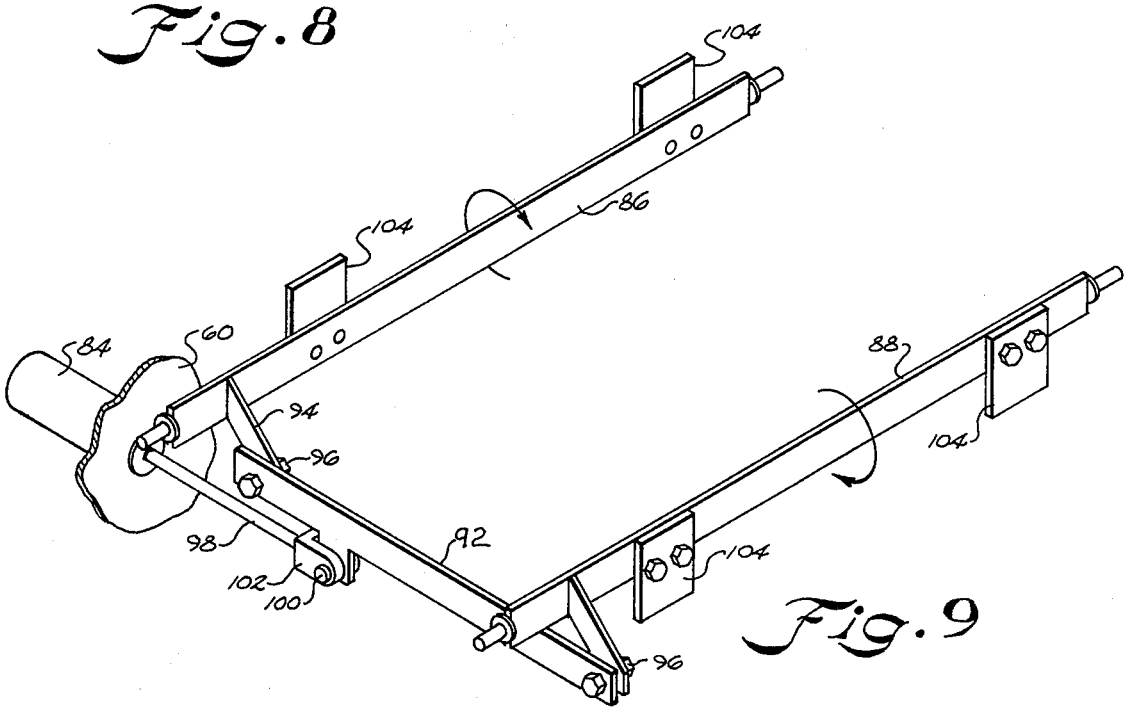

FIG. 7 and FIG. 8 are side elevational views illustrating a camming mechanism that is utilized with the guide arms for restricting the flow of articles therethrough, and FIG. 9 is an enlarged perspective view illustrating the camming mechanism that is used with the guide arms.

DESCRIPTION OF A PREFERRED EMBODIMENT

Figure 1:
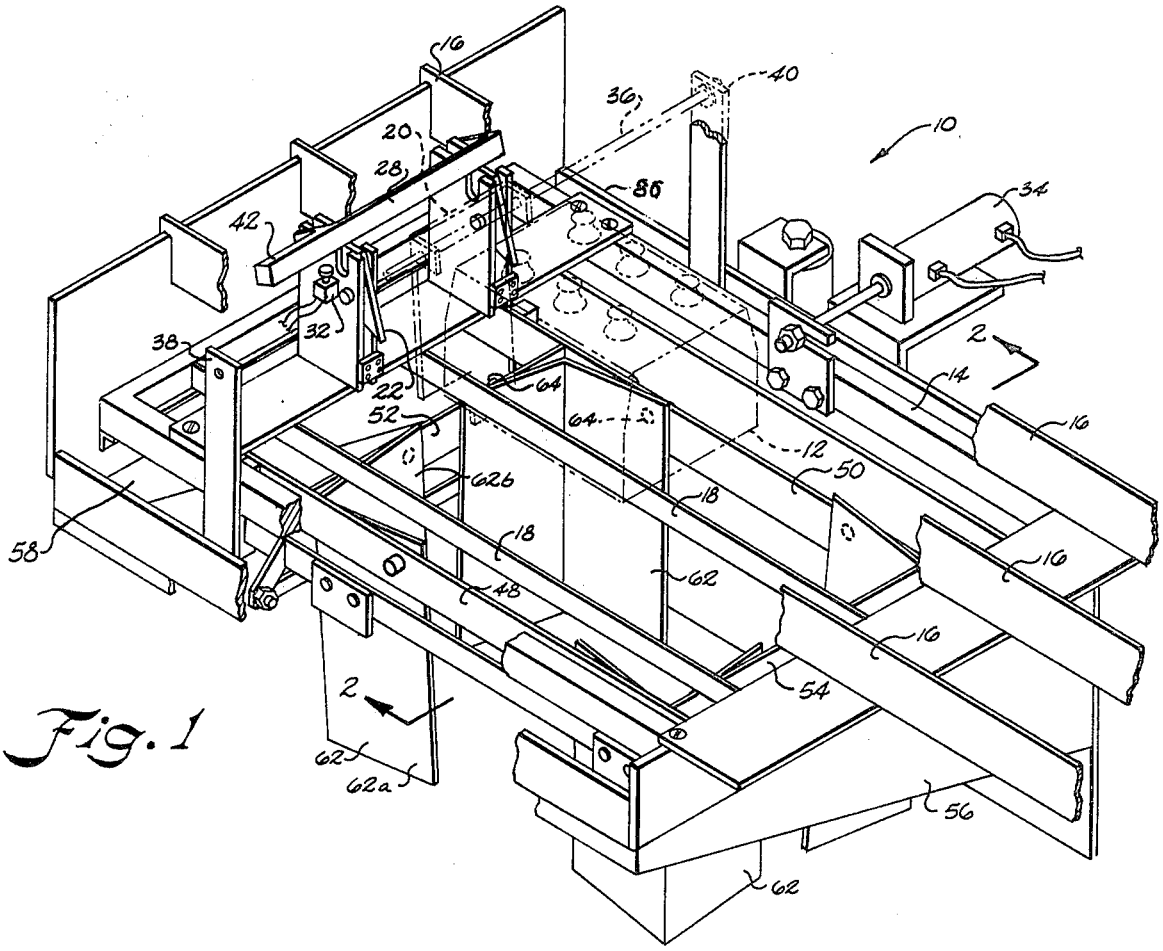
FIG. 1 is a perspective view with parts removed for purposes of clarity illustrating a grid set for an article loading machine constructed in accordance with the present invention.

Referring to FIG. 1 of the drawings, there is illustrated generally by the reference character 10, a portion of a grid set that may be used for loading articles such as six-pack carton of drinks within a case. In our copending application, Ser. No. 940,373, entitled ARTICLE RETARDING DEVICE FOR CASE LOADING MACHINES, filed on Sept. 7, 1978, there is illustrated a grid set wherein a group of individual bottles are dropped through fingers into individual compartments of a case. As the individual bottles are dropped through the grid set, the fingers are brought to a closed position for stopping the bottles from dropping the entire distance from above the case loading machine to the case.

In U.S. Pat. No. 3,788,034, there is illustrated a more conventional article loading machine wherein bottles are deposited through a grid set into cartons carried in a case. The case is raised on an elevator to a loading position directly under the grid set. The grid set constructed in accordance with the present invention could be utilized on a machine such as shown in U.S. Pat. No. 3,788,034.

There is shown in FIG. 1, a carton 12 containing six bottles being fed onto a trip-bar assembly 14. As the cartons are fed onto the trip-bar assembly, they are separated by vertically extending divider plates 16. The divider plates are broken for purposes of clarity. When the cartons are fed onto the trip-bar assembly, at least one row of the bottles carried in the carton 12 rides on one of the bars 18. They are forced to the left of the grid assembly shown in FIG. 1 until the cartons press against the pivotal plates 20. As the leading carton 12 presses against the pivotal plate 20, the plate, in turn, presses against a pivotal member 22 which is pivoted about a pivot point 23 to a vertically extending position. In order for the trip bar assembly to be activated, both of the pivotal members 22 associated with the mechanism for controlling the trip bar assembly must be pushed between the plates 24.

The pivotal members 22 are in turn sandwiched between a pair of vertically extending plates 24 which have U-shape slots 26 provided in the top thereof. A corresponding U-shape slot is provided in the pivotal member 22 so that when the pivotal member is pivoted to the vertical position by the plate 20 pressing thereagainst, a bar 28 is allowed to drop into the slot 26. As can be seen in FIG. 1, the bar 28 extends across both of the trip assemblies so that in order for the bar 28 to pivot on pivot point 30, a carton must be pressed against each of the pivotal plates 20. When this occurs, the bar 28 is allowed to drop into the aligned slots 26 activating an electrical switch 32. The electrical switch 32 is in turn connected to a solenoid valve for supplying air pressure to one end of a cylinder 34 for shifting the trip-bar assembly to the left for dropping the carton of bottles therethrough.

Figure 2:
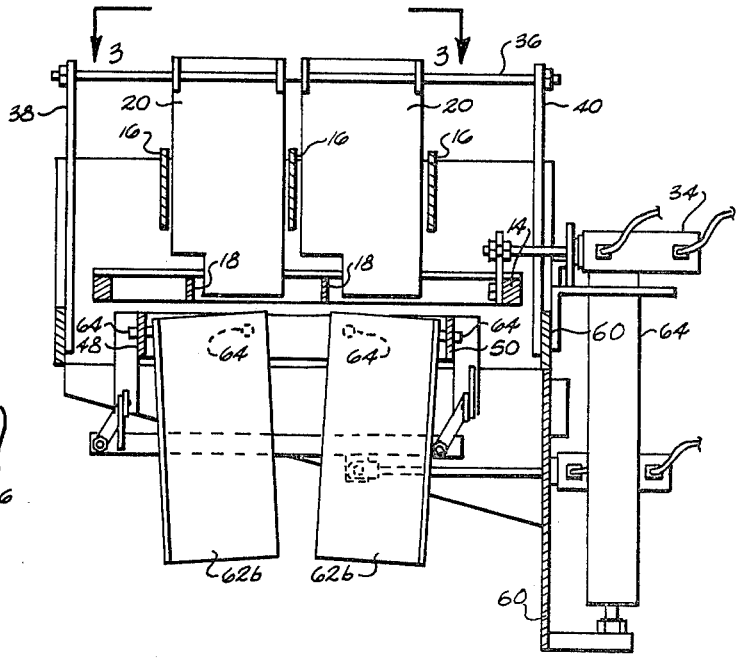
FIG. 2 is a sectional view taken along line 2—2 illustrating the grid set of FIG. 1 with pivotal plates provided thereon.

The plates 20 are pivotally hung on a horizontal rod 36 which extends between brackets 38 and 40. As illustrated in FIGS. 2 and 5, there is a pivotal plate provided for each of the triggering mechanisms 22 so that when a carton is pushed against the plate 20, it forces the lever 22 back in between the plates 24 for aligning the slots carried in the top portion thereof.

Positioned adjacent one end of the bar 28 is a weight 42 which causes the bar 28 to fall within the aligned slots provided in the plates 24 and 22 when all of the vertical plates 20 are pushed into engagement with the pivotal members 22.

Figure 3:
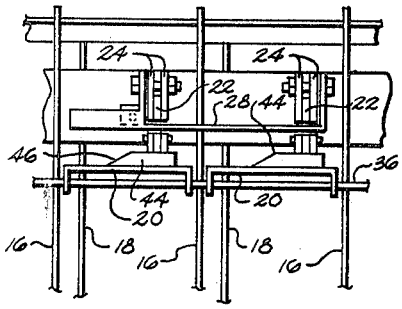
FIG. 3 is a sectional view taken along the line 3—3 of FIG. 2.

As can best be seen in FIG. 3, positioned on the rear surface of the plates 20 is an elongated abutment 44 which has a tapering end portion 46 provided thereon. The abutment 44 presses against the plates 24 when the cartons are being loaded onto the case packer. However, after the trip-bar assembly has been activated by the cylinder 34, the triggering device which includes the plates 24 are shifted laterally to the left with the trip bar assembly. As the plates 24 move beyond the slanted portion 46 of the abutment 44, it permits the plates 20 to pivot further towards the left-hand end of the grid set as shown in FIG. 1. This prevents binding between the cartons and the end of the grid set so as to permit the cartons to drop freely between the bars 18 down through the grid set. If the pivotal plates 20 were eliminated, the pressure of the incoming cartons bearing against the four cartons carried on the trip-bar assembly would sometimes be sufficient to prevent the cartons from dropping therethrough even though stops are utilized for retaining the incoming flow of cartons.

Positioned below the trip bar assembly is a substantially rectangular frame including a pair of elongated bars 48 and 50 which are joined by end bars 52 and 54. These bars are, in turn, suitably secured to side frame members 56 and 58.

A rear back plate 60 is connected between the side frame member 56 and 58.

A guide arm 62 is carried in each corner of the frame defined by the members 48, 50, 52 and 54. The guide arm is constructed of a rigid piece of elongated sheet-metal that is bent at a right angle so as to define a pair of side walls 62*a* and 62*b* that are joined at right angles to each other. The guide arms are connected by means of pins 64 to the frame members 48 through 54. As seen in FIG. 4, the pins are welded to the rear side of the side plates 62*a* and 62*b* and extend through holes provided in the adjacent frame member. The pin is positioned outwardly beyond the center of a respective side wall away from the corner so that the guide arm under normal free-hanging conditions will pivot towards the center of the frame.

As previously mentioned, the frame is secured between the side plates 56 and 58 which are joined by the rear plate 60 and is raised and lowered by a pneumatic cylinder 64 such as best illustrated in FIGS. 2 and 4. The back plate 60 has a pair of vertically extending blocks 66 and 68 positioned adjacent each edge thereof which have sandwiched therebetween a guide post 70. As the grid set is raised and lowered by the pneumatic cylinder 64, the entire apparatus rides up and down on the posts 70 and is guided by the low friction elongated members 66 and 68 on the posts 70.

The pneumatic cylinder 64 has a piston 72 extending out the end thereof that is attached to a flange 74 which, in turn, has its inner end secured to the back plate 60. In FIG. 4, when the grid set is in the raised position, it assumes the position shown in the full lines and when the grid set is in its lowered position for depositing the cartons of drinks into a case 76, it assumes the position shown in phantom lines. The fixed portions of the case packer are supported on rails 78 which have vertically extending columns 80 projecting upwardly therefrom upon which a C-channel member 82 is carried. A similar support is provided on the other side of the case packer. As is illustrated, a rigid bar 83 is connected between the C-channel 82 and a side plate 85.

Suitable bars are, in turn, connected to the side plate 86 defining a frame upon which a conventional trip bar assembly is carried. Such is of conventional construction and the details of the framing mechanism are not illustrated for purposes of clarity.

As previously mentioned, the guide arm 62 is pivotably supported in the corners of the frame so that the bottom portion thereof normally hangs toward the center of the frame. It is also desirable that the guide arms be forced inwardly towards the center of the frame so as to prevent cartons of drinks from dropping therethrough prior to the grid set being lowered adjacent the case.

In order to accomplish this, cam means are carried adjacent the guide arms 62 and means including a pneumatic cylinder 84 is provided for selectively moving the cam means into and out of engagement with the guide arms such as illustrated in FIGS. 7 and 8.

The cams means includes a pair of elongated bars 86 and 88 which are carried on opposite sides of the guide arms and are pivotally secured in blocks 90 carried on the side of the frame. A linkage arm 92 engages the pair of spaced members 86 and 88 by means of intermediate arms 94. A pivotal connection through bolt 96, is provided between the linkage arms 92 and 94. A piston 98 extending out of the pneumatic cylinder 84 is connected by a pin 100 extending through a fork 102 to the linkage arm 92.

Camming members 104 are carried on the elongated bars 86 and 88 and when the bars are in position such as shown in FIG. 9, extend vertically. However, when the piston rod 98 is retracted, the camming members are pivoted from a vertical position such as shown in FIG. 7, to a substantially horizontal position such as shown in FIG. 8, forcing the guide arm members towards the center of the frame. When the guide arm members are in the position shown in FIG. 8, the cartons are held therebetween until the grid set is lowered. Once the grid set is lowered to a position shown in FIG. 4, the piston rod 98 of pneumatic cylinder 84 is extended retracting cam members 104 to the position shown in FIG. 7 allowing the cartons of drinks to be gently deposited on the cardboard case 76.

The guide arm members 62 also have another function in that as they are extended into the cardboard case 76 such as shown in FIG. 8, and the camming members 104 retracted, the weight of the full drink cartons carried therein force the guide arm members back into the corners of the frame and the bottom corners of the guide arm members 62 engage the inside corners of the cardboard case into which the cartons are to be deposited. This insures that the cardboard case is properly positioned relative to the grid set and is fully extended for receiving four six-pack cartons of drinks.

The pneumatic cylinder 84 is secured to the movable rear wall 60 and is raised and lowered therewith for selectively operating the camming mechanism.

A switch 106 is carried on the vertical column 70 and has an arm 108 provided thereon positioned in the path of a flange 110 that is carried by the vertical bracket 66 connected to the elevator. As a result, when the elevator is lowered to the position shown in phantom lines in FIG. 4 the switch 106 is tripped. When switch 106 is tripped such causes a solenoid valve 111 as shown schematically in FIG. 4A, to supply air to the forward port **84*a* of cylinder 84 which, in turn, causes the camming members 104 to be rotated from the position shown in FIG. 8 to the retracted position shown in FIG. 7**, allowing the cartons to be deposited in the case.

Referring in more detail to FIG. 4A of the drawing, there is illustrated schematically electrical controls and a pneumatic circuit for the cylinders. As the switch 32 is depressed by the weight 42 when the bar 28 drops in the aligned slots in the members 24 contact is made between the electrical supply and terminal **32*a*. This activates both solenoid valves 111 and 112. When solenoid valve 111 is activated, pressurized air flows therethrough to inlet port 84*b* of cylinder 84 for rotating the cams to force the fingers toward the center of the frame. Simultaneously therewith air is supplied through valve 112 to port 34*a* causing the cylinder 34 to shift the drop-bar assembly allowing the articles to be dropped therethrough. As the drop-bar assembly is shifted laterally, another switch (not shown) is activated for causing the elevator to be lowered. As the elevator is lowered the switch 32 resumes its initial position in contact with terminal 32*b*. This is accomplished by lifting the weight 42 off of the switch element 32** by means of a cam that is operably connected to the elevator. This camming device is not illustrated since it does not form a part of the subject invention.

As the elevator is lowered with the articles held in the grid set by the guide arms 62 being forced thereagainst by means of the cams 104, the bracket 110 engages switch arm 108 of switch 106.

When the switch 106 is closed, solenoid valve 111 is triggered allowing air to flow to input port **84*a* of cylinder 84. The cylinder 84, in turn, causes the camming members 104 to assume the position shown in FIG. 7 allowing the cartons of drinks to be deposited in the case therebelow. As the cartons are deposited in the case they force the guide arms 62** back into the corners of the case insuring that the case is fully extended and properly positioned.

While a preferred embodiment of the invention has been described using specific terms, such description is for illustrative purposes only and it is to be understood that changes and variations may be made without departing from the spirit or scope of the following claims.

What is claimed is:

1. A grid set for use on an article loading machine for guiding a charge of articles carried on a drop assembly from said drop assembly to an empty case carried therebelow, said case having four walls intersecting at substantially right angles defining four corners, said grid set comprising:

a frame carried below said drop assembly;

said frame including four elongated support members joined at right angles defining four corners;

a guide arm carried in each corner of said frame;

each of said guide arms including a pair of elongated downwardly extending planar side walls joined at a substantially right angle;

means for pivotally supporting said guide arms in respective corners of said frame with the lower ends of said guide arms being pivoted towards the center of said frame;

whereby when said charge of articles is dropped through said grid set for being loaded into said case said articles strike said guide arms forcing said arms back into a respective corner of said case ensuring that said case is fully extended for receiving said articles therein.

2. The grid set as set forth in claim 1 further comprising:

said means for pivotally supporting said guide arms including:

(i) a pair of holes provided in said elongated members adjacent each corner of said frame, (ii) a pin extending outwardly from each side wall of each guide arm adjacent a top portion of said guide arm and being inserted in a respective hole provided in said frame members, and (iii) each pin being located laterally beyond the center of a respective side wall relative to said corner of each guide arm, whereby said guide arms hang freely on said pins and said lower ends thereof extend towards the center of said frame.

3. The grid set as set forth in claim 1 further comprising:

cam means carried adjacent said guide arms;

means for selectively moving said cam means into engagement with said guide arms forcing said guide arms towards the center of said case for stopping the downward movement of said charge of articles;

means for selectively moving said cam means to a retracted position for allowing said guide arms to pivot back into the corners of said case while depositing said articles into said case.

4. The grid set as set forth in claim 3 further comprising:

means for lowering said grid set with said charge of articles therein for gently depositing said charge of articles into said case.

5. The grid set as set forth in claim 1 further comprising:

cam means carried adjacent said guide arms;

means for selectively moving said cam means into engagement with said guide arms forcing said guide arms towards the center of said frame as said articles are dropped by said drop assembly for catching said articles;

means for lowering said grid from adjacent said drop assembly to adjacent said case; and means for selectively moving said cam means to a retracted position responsive to said grid being lowered adjacent said case for allowing said guide arms to pivot back into the corners of said case for insuring said case is extended and for gently depositing said articles into said case.

6. An apparatus for use on a case packer for insuring free dropping of articles into a case, a drop-bar assembly for receiving said articles, a conveyor feeding said articles in rows onto said drop-bar assembly and means for shifting said drop-bar assembly causing said articles to drop therethrough into said case, the improvement comprising:

a movable abutment means carried adjacent an end of said drop-bar assembly for engaging the leading articles being fed onto said drop-bar assembly and stopping said articles;

means for permitting said abutment to be shifted in a direction away from said leading articles responsive to said drop bar assembly being shifted for allowing said articles to drop freely through said drop-bar assembly into said case;

said movable abutment means including:

a pair of pivotal plates;

means for holding said pivotal plates in a fixed position as said articles are loaded on said drop-bar assembly; and said means for permitting said abutment to be shifted including means for disengaging said means for holding said pivotal plates allowing said plates to pivot in a direction away from said articles.

7. A guide arm for use in a grid set of an article loading machine, a charge of articles carried on a drop assembly above a substantially rectangular frame, one of said guide arms carried in each corner of said rectangular frame, a case carried below said drop assembly and said substantially rectangular frame for receiving said charge of articles, said guide arm comprising:

a pair of rigid planar side walls joined at a substantially right angle defining a corner;

a pin connection provided between each of said side walls and said frame pivotally supporting said guide arm adjacent a respective corner of said frame; and said pin connection being spaced laterally beyond the center of a respective side wall away from said corners.

* * * * *